United States Patent [19]

Bay

[11] 4,097,930

[45] Jul. 4, 1978

[54] HELMET SHIELD APPARATUS

[76] Inventor: William P. Bay, Rte. 1, Box 53, Ormond Beach, Fla. 32974

[21] Appl. No.: 774,386

[22] Filed: Mar. 4, 1977

[51] Int. Cl.[2] ..... A42B 3/00

[52] U.S. Cl. ..... 2/10; 24/208 A

[58] Field of Search ..... 2/10, 6, 8, 9, 424; 24/208 A, 216

[56] References Cited

U.S. PATENT DOCUMENTS

| | | | |
|---|---|---|---|
| 3,478,365 | 11/1969 | Varga | 2/424 |
| 3,806,951 | 4/1974 | Halteman | 2/10 X |
| 3,965,952 | 6/1976 | Rivman et al. | 24/208 A |
| 4,023,210 | 5/1977 | Hanson | 2/10 |

FOREIGN PATENT DOCUMENTS

| | | | |
|---|---|---|---|
| 1,433,619 | 4/1976 | United Kingdom | 2/10 |

*Primary Examiner*—Werner H. Schroeder
*Assistant Examiner*—Peter Nerbun
*Attorney, Agent, or Firm*—Duckworth, Hobby, Allen & Pettis

[57] ABSTRACT

A snap-on shield for a helmet is formed having a flat, transparent surface which can be shaped to fit onto a helmet, or a molded pre-curved surface, to protect the face of a wearer. The shield is injection-molded of a polymer material having a molded female center snap portion for engaging a male snap portion on the helmet and a pair of groups of female polymer snaps are molded for one snap portion to engage each male ear stud snap on the helmet. Each group of female snap portions is positioned so that one snap portion fits the ear stud male snap portion of at least one helmet. The shield may also have additional male snap portions molded therein for engaging female snaps on a visor. The face shield with snap fastener portions is molded in one piece to fit a large variety of helmets having variations in the positioning of the helmet snap fastener portions thereon.

9 Claims, 5 Drawing Figures

10
24
25
17
14
13
14
2
23
18
20
23
22
15
11
26
12
21
16
2
37
27

HELMET SHIELD APPARATUS

BACKGROUND OF THE INVENTION

The present invention relates to face shields and especially to motorcycle face shields for attaching to protective helmets and the like, and especially to such a face shield adapted to fit a wide variety of helmets.

In the past, a variety of helmets have been designed for use by motorcycle riders, race car drivers, and the like, to protect the head of a user against damage in the event of an accident. The helmets typically provide a male portion of a snap fastener for attaching thereto, so that a face shield may be attached to the helmet. The face shield protects the user of a motorcycle from the wind, rain, and the like, when riding the motorcycle, and may be snapped off when not needed or desired. It may be easily replaced in the event that the face shield is damaged, inasmuch as a number of manufacturers make helmets, which manufacturers may typically make a matching face shield in which the snap fastener portions are positioned to co-operate with the snap fastener portions on the manufacturers' shield. This has presented somewhat of a problem to provide a shield that will fit all or most helmets on the market. To overcome this problem, a number of solutions have been proposed. One common technique now used for making face shields adaptable to a larger number of helmets has been to mold the face shield with T-shaped slots located over the portion to engage the ear snap fastener of the helmet and also with a vertical slot for the center snap fasteners and a horizontal slot for the two outboard snap fasteners. Female snap fastening portions are then connected with studs through these slots loosely so that the fasteners can slide around in the slots to adjust the positions of the snap fasteners to fit these particular helmets. This has worked satisfactory, but metal snap fasteners which use female sockets with brass or bronze rings mounted therein are expensive to purchase and to attach to the face shield inasmuch as they require snap machines as well as employees to operate the snap machines to place the snap fasteners in place. This results in a number of rejects associated with the snap fastener machinery. In addition, the metal snap fasteners' being loosely fitted with ring snaps therein tend to rattle when wind currents or stresses are put upon the attached face shield. To overcome these problems, one manufacturer has suggested providing a shield with a series of slots in a plastic face shield which will simply snap on the male fasteners of the helmet directly through the slots to hold the face shield in the slots. This however, has proved inadequate because the snap fasteners fit the slots in the same place for each brand helmet and while satisfactory the first few times the shield is snapped upon the helmet, the shield rapidly loosens as the plastic is stretched and even hobbed by the snapping of the male snap fastener through the thin edge of plastic of the slot. One of the difficulties in matching the shield to the helmet has been the use of a center snap along with outboard snaps and ear snaps which require fairly precise lining up of all the snap fasteners. The present invention, on the other hand, eliminates the outboard snap fasteners on the face shield, and has fixed positions for all of the remaining snap fastener portions. Thus, the center female snap fastener portion connects directly to the male center snap fastener portion of the helmet, and without outboard snap fasteners to align that portion of the helmet, the shield can be pulled back into position to engage one of a plurality of female ear snap fasteners. This allows the manufacturer to utilize a face shield of one molded piece, to substantially reduce the cost of making the face shield which does not rattle. The female plastic fasteners thus provide a strong holding action with the metal male fastener portions on the helmet. In addition, male snap fastener portions can be molded directly into the shield for engaging a visor that can be added to the front of the helmet and shield to shade the eyes of a user.

Frequently shields are subjected to high wind speeds while used during racing or normal riding and it becomes advantageous to use the very tightest action snaps so as to prevent the shield from unsnapping and thereby disorienting the wearer which may cause an accident. Since all metal female ring snaps or sockets have a ring which is not unified, they cannot be made as tight as would be possible, since to do so would mean the broken ring would have to be made so small it would be too small to stretch over the male stud portion when attempting to snap it on, and would thereby not snap on at all. It would also stretch the metal beyond its tensile limits resulting in permanent deflection. It is desirable to have a snap ring having a diameter that will work on one or several manufacturers' studs in the same general size class. A hard action socket would be totally unsatisfactory on the smallest of studs to be found (about 0.382 inches-head diameter) and very difficult to use because it would be too hard an action on the largest of studs found (about 0.398 inches-head diameter). An important factor is that less expensive plastics of a transparent optical grade typically have a reasonable freedom from shattering, however, do not work well if manufactured as a socket and stud assembly and affixed to the shield slots such as metal snaps are used. This is because the sockets stretch and permanently deform more and more as they are continually snapped.

In the present snap, the socket's base is a part of the shield thereby preventing stretching and making it possible for a tighter action than metal ring snaps provide. Even a socket made a part of the shield must be made 0.004 to 0.006 inches smaller in diameter than the smallest stud widely marketed, and a 30°–45° entry ramp is desirable in order to make possible the pressure required to snap the socket onto the stud by an average person.

If a polymer such as polycarbonate is used, the interior of the socket must be made large enough that once the socket is snapped onto the stud it is not under continual pressure from the stud diameter pushing against it. Otherwise, it will fail when its stress limits are exceeded (about 500 to 1,000 hours of being snapped onto a helmet). A variety of polymers can be used with the present invention making it possible to manufacture inserts of sockets and seal, or to weld or snap the unit into the shield proper.

SUMMARY OF THE INVENTION

A helmet snap-on shield is provided having a transparent flat, shield surface of a predetermined shape to fit onto the front of a motorcycle helmet. This shield has a polymer female center snap portion formed thereon adjacent the top edges of the shield for cooperation with a male snap portion located on a helmet. The shield has a pair of female grouped polymer snap portions molded into or formed on either end thereof in the shield, located adjacent to the outer edges with each snap fastener portion of each group being located to fit a snap fastener portion on one of a variety of helmets whereby the shield with predetermined snap fastener locations' portions can be molded therein to fit a variety of helmets while eliminating the outboard snap fasteners and which may be provided with molded male plastic snap fastener portions to attach a helmet visor.

BRIEF DESCRIPTION OF THE DRAWINGS

Other objects, features and advantages of the present invention will be apparent from the written description and the drawings in which.

DESCRIPTION OF THE PREFERRED EMBODIMENT

Figure 1:
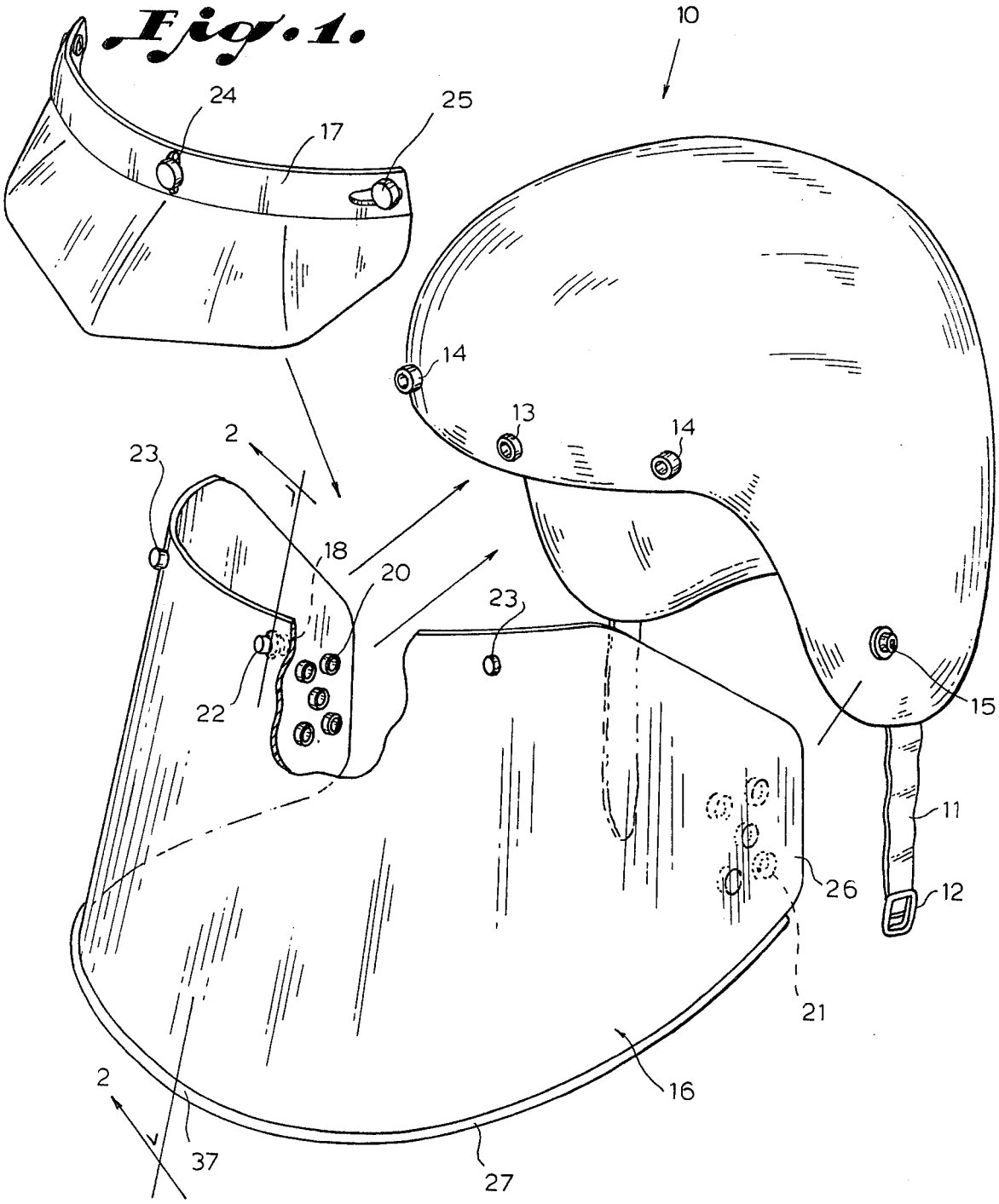
FIG. 1 is an exploded perspective view of a motorcycle helmet having a shield in accordance with the present invention and a visor for attachment together.

Referring now to the drawings, and especially to FIG. 1, a motorcycle helmet 10 is illustrated having a strap 11 with a buckle 12 and having a plurality of male snap fastener portions including a center snap fastener 13, a pair of outboard snap fastener portions 14, and a pair of ear stud or snap fastener portions 15. A face shield 16 is adapted to be attached to the helmet 10 and a visor 17 is adapted to be attached to the front of the shield 16. The face shield 16 includes a center female snap fastener portion 18 as well as a group of five female snap fastener portions 20 on one end of the shield 16 and a second group of five snap fastener portions 21 on the opposite side of the shield 16. In addition, the shield has molded in male snap fastener portions, including a center snap fastener portion 22 and a pair of outboard snap fastener portions 23 for engaging a center female snap fastener portion 24 and outboard snap fastener portions 25 of the visor 17. The outboard snap fasteners 14 on the helmet 10 have not equivalent on the shield 16 so that the center snap fastener portion 18 can snap onto the center snap fastener portion 13 of the helmet 10 for a secure fit in the center of the helmet, while allowing some flexibility to each end portion 26 of the face shield 16 for pulling the end portion 26 of the face shield back for engagement with the snap fastener portion 15 of the helmet 10. The five snap fasteners of each group in 20 and 21 are positioned in accordance with a large variety of helmets so that one of the snap fasteners in each group 20 and 21 will align with the male snap fastener of the helmet 10 once the single snap fastener 18 is attached to the snap fastener portion 13.

It should be clear that the shield 16 can be molded in one piece, with the snap fasteners 18, 20, 21, and 22 each being made of the same material as the shield 16, or if desired, can be made of a separate polymer material two shot molded or heat molded (if made of another material) onto the shield at the appropriate points. The plastic shield provides strength comparable or superior to metal fasteners which have additional snaps engaging the outboard snaps 14 of the helmet 10 while eliminating these snaps from the shield 16. The elimination of the two outboard sockets allows the shield to be moved sufficiently to allow alignment with different helmets having ear snap fastener portions 15 positioned at different positions relative to the center snap 13 and outboard snaps 14. Thus, the outboard snap fastener portions are not used in a one piece molded shield unless the shield was designed for one predetermined helmet. The outboard snap fastener positions could be used, but the shield may or may not have an unsightly bulge if the ear snap 15 on the helmet 10 does not happen to exactly coincide with one of the plurality of snaps at 20 or 21. This substantially reduces the cost of the shield inasmuch as metal snaps are the most expensive components of the shield, other than the shield itself, and must be machine set with two snap machines for each production line along with two employees to operate the machine and which also results in rejects associated with the snap machinery. In addition, the plastic snap fasteners, designed with no interior clearance, do not rattle as does the metal snaps.

Figure 2:
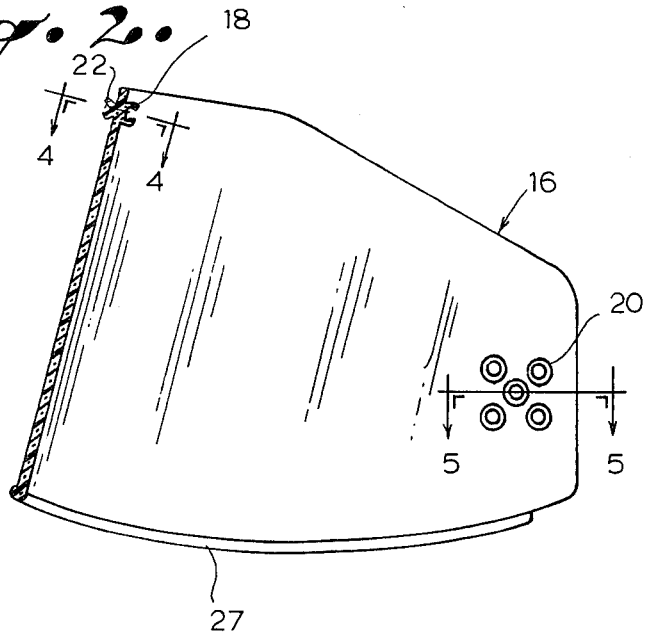
FIG. 2 is a sectional view taken on the Line 2—2 of FIG. 1.
Figure 4:
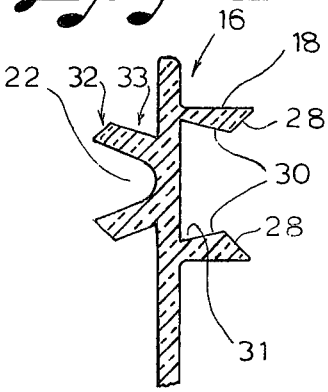
FIG. 4 is a sectional view taken on the Line 4—4 of FIG. 2.
Figure 5:
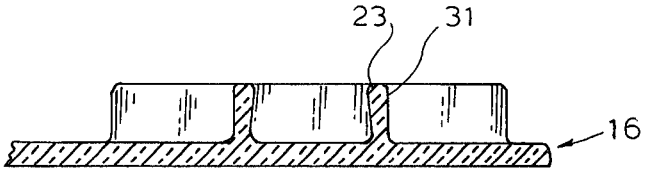
FIG. 5 is a sectional view taken on the Line 5—5 of FIG. 2.

Turning now to FIGS. 2, 4, and 5, shield 16 of FIG. 1 is illustrated having female snap portion 18 along with one group of five female snap portions 20 and a center male snap portion 22 located to receive a visor snap. The shield may also have a reinforced edge portion 27. The center snap portion is illustrated in FIG. 4, in which the shield 16 has the center snap 18 having a steep angle annular entry ramp 28 along with an annular lip 30 and an annular recessed portion 31. By the use of a predetermined polymer of sufficient resiliency, the largest and smallest diameter male studs normally used on helmets will fit in the snap fastener 18. The plastic snap fastener makes it possible to affix the shield with maximum tightness making it unnecessary to manufacture several different sized snaps or shields. In addition, prior art plastic snap fasteners would require the drilling of a hole in the part to be attached and the extension of a post therethrough, and the attaching of the post on the opposite side, and would be an open tube which would stretch each time it was snapped onto a stud. This results in the stud passing through the opening being under continual stress and soon stretches the opening larger, and results in a loosened action. Making the socket wall thicker only provides for a slight delay in the time necessary for the stretching of the plastic socket to be completed.

Figure 3:
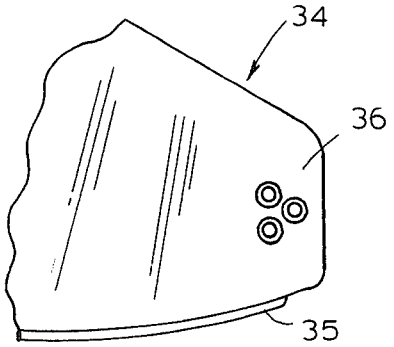
FIG. 3 is a cut-away sectional view of a second embodiment of a group of snap fasteners.

The present plastic fasteners are molded directly into the shield, thus requiring no hole and no male post portion, and eliminating the additional cost of attaching the fasteners and avoiding prior problems since there is no male post hole in the socket to stretch or to let the opening stretch since it becomes a closed tube at one end by being molded into and a part of the shield 16. The present design of snap fasteners as illustrated in FIG. 4 has the ramp 28 to allow a much smaller socket to be snapped onto studs of several different sizes in a rapid and quick snapping action and similarly the male snap fasteners 22 have an annular lip 32 and an annular recessed portion 33 for engaging metal or plastic female snap portions on a visor, or the like. The same type of fastener in the group of fasteners 20 is used having the same ramp 28 and recessed area 31 for each snap fastener. Referring to FIG. 3, an alternate embodiment is illustrated having a face shield 34 with reinforcing ledge 35 and a group of snap fasteners 36 on one end edge portion of the shield 34. The group of snap fasteners 36 provides only three snap fasteners positioned to accept a number of helmets but not as many as might be provided for the group of five as illustrated in FIGS. 1, 2, 4, and 5. It should be clear at this point, that a new face shield has been provided for motorcycle and other helmets, which can be made of a molded polymer piece. Injection molding takes place from a center point in the lower center of the face shield, so that the reinforcing portion 27 acts as a flow channel for the plastic during injection molding. Research has indicated that a polycarbonate polymer shield, which is higher in cost that the usual plastics, will not always withstand the continual stress when molded flat and then formed into the helmet, and thus, it is required to be molded in a curved style which makes the shield of the present invention more difficult to mold, requiring a more complex molding die. The socket relief area 31 must be larger or the same size as the largest stud to be found on marketed helmets. Polycarbonate, however, provides the necessary strength required in the polymer fasteners; and it is a preferred material for molding the present shields.

It should be clear at this point that a face shield for helmets has been provided which eliminates not only the vertical slot at the center of the shield, which is the weakest point and where most shields fail, but also the other slots in universal type shields. The cost saving permits the use of the higher cost polycarbonate resins in its manufacture to allow a cost competitive shield of polycarbonate at the same cost as lower cost resin made shields utilizing metal snaps or when made of lower cost resins allows a much lower cost shield to be manufactured than before possible. It should be clear, however, that other embodiments are contemplated as being within the scope of the invention, which is not to be construed as limited to the particular forms shown, which are to be considered illustrative rather than restrictive.

I claim:

1. A helmet snap on shield comprising in combination:

a transparent flat shield of predetermined shape to fit onto a helmet and having two sides with a top, bottom, and two end edges;

a polymer center snap portion formed on said shield, adjacent said top edge of said shield and between the end edges thereof for cooperation with a snap portion located on a helmet; and a pair of grouped polymer snap fastener portions formed in said shield, each group being located adjacent one said end edge of said shield, and each snap fastener portion of each group being located to fit a snap fastener portion on a helmet, whereby a shield having snaps molded therein fits a variety of helmet designs.

2. A helmet snap on shield in accordance with claim 1, in which said polymer center snap portion and grouped polymer snap fastener portions are female snap fastener portions for accepting male snap fastener portions located on a helmet.

3. A helmet snap on shield in accordance with claim 2, in which a plurality of male snap fastener portions are molded onto the opposite side of said shield in predetermined locations on the opposite side of said shield from said female snap fastener portions.

4. The helmet snap on shield in accordance with claim 3, in which one said male snap fastener portion is positioned directly opposite said center snap fastener portion formed on said shield and two additional male snap fastener portions are positioned outboard of said center snap fastener portion along the top edge of said shield.

5. The helmet snap on shield in accordance with claim 1, in which each of said pair of groups of polymer snap fastener portions includes five snap fastener portions.

6. The apparatus in accordance with claim 1, in which each of said pair of grouped polymer snap fastener portions includes three snap fastener portions.

7. The apparatus in accordance with claim 1, in which said center snap fastener portions and each of said grouped polymer snap fastener portions has a polymer snap fastener portion having an annular ramp portion for directing a male snap fastener portion therein and an annular lip and recessed portion for retaining the male snap fastener portion therein.

8. The apparatus in accordance with claim 1, in which said shield and said snap fastener portions are of one piece, molded polycarbonate shield.

9. The helmet snap on visor in accordance with claim 1, in which a molded visor has snaps thereon positioned to attach to the male visor snaps on said face shield.

* * * * *